US008691743B2

(12) United States Patent
Kellar et al.

(10) Patent No.: US 8,691,743 B2
(45) Date of Patent: Apr. 8, 2014

(54) LIQUID DETERGENT COMPOSITIONS

(75) Inventors: Kenneth Edmund Kellar, Blue Ridge, VA (US); Christina Edwards, Boones Mill, VA (US); Domenic Paone, Roanoke, VA (US); Megan Allen, Fincastle, VA (US)

(73) Assignee: Novozymes A/S, Bagsvaerd (DK)

( * ) Notice: Subject to any disclaimer, the term of this patent is extended or adjusted under 35 U.S.C. 154(b) by 0 days.

(21) Appl. No.: 12/934,355

(22) PCT Filed: May 14, 2009

(86) PCT No.: PCT/US2009/043932

§ 371 (c)(1),
(2), (4) Date: Sep. 24, 2010

(87) PCT Pub. No.: WO2009/140481

PCT Pub. Date: Nov. 19, 2009

(65) Prior Publication Data

US 2011/0015110 A1 Jan. 20, 2011

Related U.S. Application Data

(60) Provisional application No. 61/053,133, filed on May 14, 2008.

(51) Int. Cl.

| | |
|---|---|
| ***C11D 3/386*** | (2006.01) |
| ***C11D 7/42*** | (2006.01) |
| ***C11D 7/32*** | (2006.01) |
| ***C11D 7/04*** | (2006.01) |
| ***C11D 3/04*** | (2006.01) |
| ***C11D 3/26*** | (2006.01) |
| ***C11D 3/60*** | (2006.01) |

(52) U.S. Cl.
USPC ..... 510/393; 510/220; 510/221; 510/226; 510/235; 510/276; 510/320; 510/321; 510/337; 510/392; 510/405; 510/488; 510/530

(58) Field of Classification Search
USPC ..... 510/362, 393, 220, 221, 226, 235, 276, 510/320, 321, 337, 392, 405, 488, 530
See application file for complete search history.

(56) References Cited

U.S. PATENT DOCUMENTS

| | | | | |
|---|---|---|---|---|
| 3,827,938 | A * | 8/1974 | Aunstrup | 435/221 |
| 4,261,868 | A | 4/1981 | Hora et al. | |
| 4,305,837 | A * | 12/1981 | Kaminsky et al. | 510/393 |
| 4,318,818 | A | 3/1982 | Letton et al. | |
| 5,073,285 | A | 12/1991 | Liberati et al. | |
| 5,281,277 | A * | 1/1994 | Nakagawa et al. | 134/18 |
| 5,698,507 | A | 12/1997 | Gorlin et al. | |
| 5,733,473 | A | 3/1998 | Johnston et al. | |
| 6,624,132 | B1 | 9/2003 | Man et al. | |
| 6,835,703 | B1 * | 12/2004 | Cho et al. | 510/221 |
| 6,844,305 | B1 | 1/2005 | Depoot et al. | |
| 2005/0227896 | A1 * | 10/2005 | Speckmann et al. | 510/392 |
| 2006/0172908 | A1 * | 8/2006 | Everaert et al. | 510/235 |

FOREIGN PATENT DOCUMENTS

| | | |
|---|---|---|
| EP | 0 162 033 | 11/1985 |
| EP | 0 586 741 A1 | 3/1994 |
| GB | 1 572 605 | 7/1980 |
| WO | WO 99/50380 | 10/1999 |

OTHER PUBLICATIONS

Thermo Scientific Savinase document, 2013.*
Michael C. Crossin, JAOCS, vol. 66, No. 7, pp. 1010-1014, Jul. 1989.

* cited by examiner

*Primary Examiner* — Lorna M Douyon
*Assistant Examiner* — Amina Khan
(74) *Attorney, Agent, or Firm* — Kristin J. McNamara

(57) ABSTRACT

The present invention relates to aqueous liquid detergent compositions comprising an alkaline protease and/or one or more other non-proteolytic enzymes, and an enzyme stabilization system. The invention also relates to enhancing stability of the non-proteolytic enzymes in a liquid detergent composition comprising an alkaline protease.

22 Claims, 13 Drawing Sheets

LIQUID DETERGENT COMPOSITIONS

CROSS-REFERENCE TO RELATED APPLICATIONS

This application is a 35 U.S.C. 371 national application of PCT/US2009/043932 filed May 14, 2009, which claims priority or the benefit under 35 U.S.C. 119 of U.S. provisional application No. 61/053,133 filed May 14, 2008, the contents of which are fully incorporated herein by reference.

BACKGROUND OF THE INVENTION

1. Field of the Invention

The present invention relates to aqueous liquid detergent compositions comprising an alkaline protease and/or one or more other non-proteolytic enzymes, and an enzyme stabilization system. The invention also relates to enhancing stability of the non-proteolytic enzymes in a liquid detergent composition comprising an alkaline protease.

2. Description of Related Art

Proteases have been used in detergent compositions for many years. Aqueous liquid detergent compositions comprising a protease and one or more non-proteolytic enzymes also are well known in the art.

The major problem encountered with such compositions is ensuring a sufficient storage stability of the enzymes in detergent compositions. Enzymes generally denature or degrade in an aqueous medium resulting in a reduction or complete loss of enzyme activity. For example, enzymes can be degraded by other ingredients in a detergent composition, e.g., surfactants and builders. For example, the anionic surfactant sodium dodecylbenzene sulfonate, an effective and inexpensive surfactant, is detrimental to enzyme stability.

In addition, a protease will degrade non-proteolytic enzymes or itself in aqueous liquid detergent compositions. Thus, the residual activity of the non-proteolytic enzymes will rapidly diminish with the storage time of the detergent composition. Attaining stability for both the protease and non-proteolytic enzymes is difficult.

Attempts to improve the stability of enzymes in detergent compositions are known in the art.

U.S. Pat. No. 4,261,868 discloses liquid detergent compositions comprising enzymes and an enzyme stabilizing system comprising (a) 2-25% of a polyfunctional amino compound selected from the group consisting of diethanolamine, triethanolamine, diisopropanolamine, triisopropanolamine, and tris(hydroxymethyl)aminomethane and (b) 0.25-15% of a boron compound selected from the group consisting of boric acid, boric oxide, borax, and sodium ortho-, meta- or pyroborate.

U.S. Pat. No. 4,318,818 discloses liquid detergent compositions comprising enzymes and an enzyme stabilizing system comprising calcium ion and a low molecular weight carboxylic acid or salt, preferably a formate.

U.S. Pat. No. 5,073,285 discloses a liquid detergent composition comprising a water-insoluble organic peroxy acid, a surfactant, a pH-adjusting jump system which comprises a borate and a polyol, and a stability-enhancing polymer. The detergent composition may further comprise enzymes. The pH jump system provides a suitable pH for the detergent composition and on dilution in the wash, i.e., a low pH of 3-6 during storage to enhance the stability of the organic peroxy-acid bleach and a higher pH of 7-9 during washing for bleaching and detergent efficacy.

U.S. Pat. No. 5,733,473 discloses a liquid detergent composition comprising a protease, lipase, and an enzyme stabilization system selected from the group consisting of boric acid, 1,2-propanediol and carboxylic acids, wherein the detergent composition has a pH from 6 to 10.

U.S. Pat. No. 6,624,132 discloses a liquid detergent composition comprising a boric acid salt (e.g., potassium borate) to stabilize one or more enzymes at alkaline pH and a concentration of water of at least 60%.

Crossin (*JAOCS* 66(7): 1010-1014 (1989)) discloses the use of short chain carboxylic acids such as formic acid for protease stabilization in a high water content, unbuilt liquid detergent composition.

However, there is a need for detergent compositions with improved stability of enzymes in liquid detergent compositions.

BRIEF SUMMARY OF THE INVENTION

The present invention relates to a detergent composition comprising (a) an alkaline protease and/or a non-proteolytic enzyme, and (b) an enzyme stabilization system comprising a water-soluble calcium salt, a polyfunctional amino compound, and a low molecular weight carboxylic acid or salt thereof, wherein the detergent composition has an acidic pH at which the alkaline protease(s) and/or non-proteolytic enzyme(s) are stable, but at which the alkaline protease(s) are virtually inactive.

The present invention also relates to methods of producing a clean fabric, comprising washing the fabric with a detergent composition at a pH of at least about 7.

DETAILED DESCRIPTION OF THE INVENTION

Figure 1:
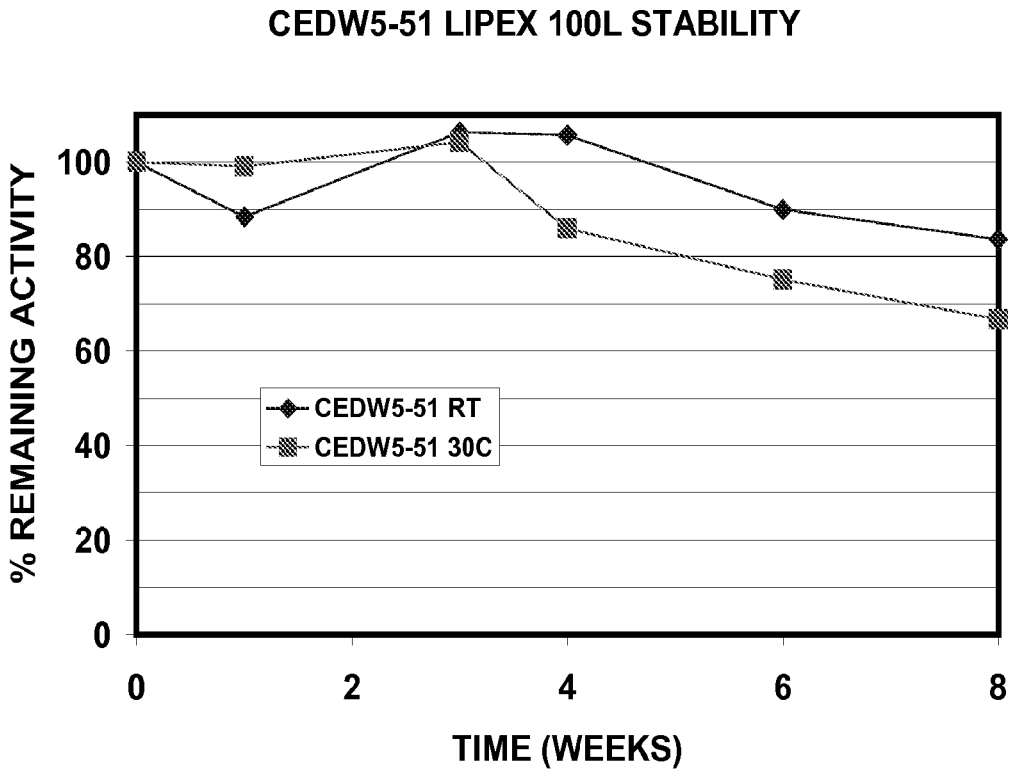
FIG. 1 shows the enzyme stability for a lipase in a detergent composition described in Example 1.

The present invention relates to a detergent composition comprising (a) one or more alkaline proteases and/or one or more non-proteolytic enzymes, and (b) an enzyme stabilization system comprising a water-soluble calcium salt, a polyfunctional amino compound, and a low molecular weight carboxylic acid or salt thereof, wherein the detergent composition has an acidic pH at which the alkaline protease(s) and/or non-proteolytic enzyme(s) are stable, but at which the alkaline protease(s) are virtually inactive.

The liquid detergent composition may be aqueous, typically containing up to 80% water and 0-30% organic solvent or non-aqueous component(s).

The detergent composition of the invention may for example be formulated as a hand or machine laundry detergent composition including a laundry additive composition suitable for pre-treatment of stained fabrics and a rinse added fabric softener composition, or be formulated as a detergent composition for use in general household hard surface cleaning operations, or be formulated for hand or machine dishwashing operations.

Alkaline Proteases

Suitable alkaline proteases include those of animal, vegetable or microbial origin. Microbial origin is preferred. An alkaline protease is defined herein to have a pH optimum of protease activity above 7, such as 8 to 12, e.g., 9 to 11.

Assay for Determining Protease Activity and pH Optimum

Substrate: Protazyme AK tablet (from Megazyme)

Temperature: 37° C.

Assay buffers: 100 mM succinic acid, 100 mM HEPES, 100 mM CHES, 100 mM CAPS, 1 mM $CaCl_2$, 150 mM KCl, 0.01% Triton X-100 adjusted to pH-values 2.0, 3.0, 4.0, 5.0, 6.0, 7.0, 8.0, 9.0, 10.0, 11.0 and 12.0 with HCl or NaOH.

Protazyme AK tablets contain cross-linked and dyed casein, which is an insoluble substrate. During the action of a protease, dyed casein-peptide fragments become soluble. A measurement of the (blue) colour of the supernatant after a short centrifugation gives a determination of the activity of the protease. The Protazyme AK assay gives a near-linear dose-response curve. If the response of an assay falls outside the near-linear part of the dose-response curve, the protease is diluted differently and the assay is repeated.

Assay:

A Protazyme AK tablet is suspended in 2.0 ml 0.01% Triton X-100 by gentle stirring. 500 microliters of this suspension and 500 microliters assay buffer are mixed in an Eppendorf tube and placed on ice. 20 microliters protease sample (diluted in 0.01% Triton X-100) is added. The assay is initiated by transferring the Eppendorf tube to an Eppendorf thermomixer, which is set to the assay temperature (37° C.). The tube is incubated for 15 minutes on the Eppendorf thermomixer at its highest shaking rate (1400 rpm). The incubation is stopped by transferring the tube back to the ice bath. Then the tube is centrifuged in an icecold centrifuge for a few minutes and 200 microliters supernatant is transferred to a microtiter plate. $OD_{650}$ is read as a measure of protease activity. A buffer blind is included in the assay (instead of enzyme). The activity of the protease is calculated as follows:

$$\text{Activity}=DF*(OD_{650}(\text{enzyme})-OD_{650}(\text{blind}))$$

where DF is the dilution factor of the protease. The pH activity profile is calculated as the activity at a certain pH value divided by the activity at the pH optimum.

The alkaline protease may be a chemically modified or protein engineered variant. The protease may be a serine protease or a metallo protease, preferably an alkaline microbial protease or a trypsin-like protease. Examples of alkaline proteases are subtilisins, especially those derived from *Bacillus*, e.g., subtilisin Novo, subtilisin Carlsberg, subtilisin 309, subtilisin 147 and subtilisin 168 (described in WO 89/06279). Examples of trypsin-like proteases are trypsin (e.g., of porcine or bovine origin) and the *Fusarium* protease described in WO 89/06270 and WO 94/25583.

Examples of proteases are the variants described in WO 92/19729, WO 98/20115, WO 98/20116, and WO 98/34946, especially the variants with substitutions in one or more of the following positions: 27, 36, 57, 76, 87, 97, 101, 104, 120, 123, 167, 170, 194, 206, 218, 222, 224, 235 and 274.

Other examples of alkaline proteases are trypsin-like proteases and proteases of the RP-II family, e.g., C-Component, disclosed in WO 94/25583 and WO 01/16285.

Other examples of alkaline proteases are the *Nocardiopsis* proteases and variants thereof disclosed in WO 01/58276, WO 2004/072221, WO 2004/111220, WO 2004/111221, WO 2005/035747, and WO 2005/123911.

Commercially available protease enzymes include Relase®, Alcalase®, Savinase® (subtilisin 309), Primase®, Everlase®, Esperase®, Ovozyme®, Coronase®, Polarzyme® and Kannase® (Novozymes A/S), Maxatase™, Maxacal™, Maxapem™, Properase™, Purafect™, Purafect OxP™, FN2™, FN3™, FN4™ and Purafect Prime™ (Genencor International, Inc.), BLAP X and BLAP S (Henkel).

Non-Proteolytic Enzymes

The detergent composition may further comprise one or more non-proteolytic enzymes such as an amylase; an arabinase; a cutinase; a carbohydrase; a cellulase; a galactanase; a hemicellulase, e.g., a mannanase; a lipase; an oxidase, e.g., a laccase and/or a peroxidise; a pectate lyase; a pectinase; a xylanase; or a xyloglucanase. In an embodiment, the non-proteolytic enzyme is an amylase and/or a lipase.

Lipases

Any lipase suitable for use in alkaline solutions can be used. Suitable lipases include those of bacterial or fungal origin. The lipase may be a chemically or genetically modified mutant.

Examples of useful lipases include lipases from *Humicola* (synonym *Thermomyces*), e.g., from *H. lanuginosa* (*T. lanuginosus*) as described in EP 0 258 068 and EP 0 305 216 or from *H. insolens* as described in WO 96/13580, a *Pseudomonas* lipase, e.g., from *P. alcaligenes* or *P. pseudoalcaligenes* (EP 0 218 272), *P. cepacia* (EP 0 331 376), *P. stutzeri* (British Patent No. 1,372,034), *P. fluorescens, Pseudomonas* sp. strain SD 705 (WO 95/06720 and WO 96/27002), *P. wisconsinensis* (WO 96/12012), a *Bacillus* lipase, e.g., from *B. subtilis* (Dartois et al., 1993, *Biochemica et Biophysica Acta* 1131: 253-360), *B. stearothermophilus* (Japanese Application No. 64/744992) or *B. pumilus* (WO 91/16422).

Examples of useful lipases include a *Rhizomucor miehei* lipase, e.g., as described in EP 0 238 023, a *Candida* lipase, such as a *C. antarctica* lipase, e.g., the *C. antarctica* lipase A or B described in EP 0 214 761.

Furthermore, the lipases may be the *Penicillium camembertii* lipase (Yamaguchi et al., 1991, *Gene* 103: 61-67), the *Geotricum candidum* lipase (Schimada et al., 1989, *J. Biochem.* 106: 383-388), and various *Rhizopus* lipases such as a *Rhizopus delemar* lipase (Hass et al., 1991, *Gene* 109: 117-113), a *Rhizopus niveus* lipase (Kugimiya et al., 1992, *Biosci. Biotech. Biochem.* 56: 716-719) and a *Rhizopus oryzae* lipase.

Examples of lipase variants are described in WO 92/05249, WO 94/01541, EP 0 407 225, EP 0 260 105, WO 95/35381, WO 96/00292, WO 95/30744, WO 94/25578, WO 95/14783, WO 95/22615, WO 97/04079 and WO 97/07202.

Other types of lipolytic enzymes such as cutinases may also be useful, e.g., a cutinase derived from *Pseudomonas*

*mendocina* as described in WO 88/09367, or a cutinase derived from *Fusarium solani* pisi (e.g., described in WO 90/09446).

In an embodiment the lipase is a variant of *Humicola lanuginosa* DSM 4109 as described in WO 00/60063, such as the variants with improved first wash performance disclosed in the Examples, i.e., T231R+N233R; G91A+D96W+E99K+G263Q+L264A+I265T+G266D+T267A+L269N+270AGGFSWRRYRSAESVDKRATMTDAELEKKLNSYVQMDKEYVKNNQARS; R209P+T231R+N233R; N33Q+D96S+T231R+N233R+Q249R; and E99N+N101S+T231R+N233R+Q249R; E99N+N101S+T231R+N233R+Q249R.

Commercially available lipases include M1 Lipase™ and Lipomax™ (Genencor), Lipolase™, Lipolase Ultra™ and Lipex™ (Novozymes A/S), and Lipase P "Amano" (Amano Pharmaceutical Co. Ltd.). Suitable cutinases include Lumafast™ available from Genencor Inc.

Amylases

Any amylase (alpha and/or beta) suitable for use in alkaline solutions can be used. Suitable amylases include those of bacterial or fungal origin. The amylase may be a chemically or genetically modified mutant. Amylases include, for example, alpha-amylases obtained from *Bacillus*, e.g., *B. licheniformis*, described in British Patent No. 1,296,839.

In an embodiment, the alpha-amylase is derived from *Bacillus* sp. strain NCIB 12289, NCIB 12512, NCIB 12513 or DSM 9375, or any of the alpha-amylases disclosed in WO 95/26397.

In another embodiment the alpha-amylase is the AA560 alpha-amylase derived from *Bacillus* sp. DSM 12649 disclosed in WO 00/60060 (hereby incorporated by reference). Especially preferred are variants of the AA560 alpha-amylase, including the AA560 variant disclosed in Examples 7 and 8 (hereby incorporated by reference).

Examples of amylases are the variants described in WO 94/02597, WO 94/18314, WO 96/23873, and WO 97/43424, especially the variants with substitutions in one or more of the following positions: 15, 23, 105, 106, 124, 128, 133, 154, 156, 181, 188, 190, 197, 202, 208, 209, 243, 264, 304, 305, 391, 408, and 444.

The amylase may be an amylase from *B. licheniformis* and other amylases disclosed in WO 2001/066712 and WO 2006/002643.

Commercially available amylases are Natalase™, Termamyl™ Ultra, Duramyl™, Termamyl™, Fungamyl™, BAN™, Stainzyme™ and Stainzyme™ Ultra (available from Novozymes A/S) and Rapidase™ and Maxamyl P™ (available from Genencor Inc.).

Cellulases

Any cellulase suitable for use in alkaline solutions can be used. Suitable cellulases include those of bacterial or fungal origin. The cellulase may be a chemically or genetically modified mutant. Suitable cellulases include cellulases from *Acremonium, Bacillus, Fusarium, Humicola, Pseudomonas*, or *Thielavia*, e.g., the cellulases produced from *Fusarium oxysporum, Humicola insolens*, and *Myceliophthora thermophila* disclosed in U.S. Pat. Nos. 4,435,307, 5,648,263, 5,691,178, and 5,776,757 and WO 89/09259. Especially suitable cellulases are the cellulases having color care benefits. Examples of such cellulases are described in EP 0 495 257.

Especially suitable cellulases are alkaline or neutral cellulases having color care benefits. Examples of such cellulases are the cellulases described in EP 0 495 257, EP 0 531 372, WO 96/11262, WO 96/29397, WO 98/08940. Other examples are cellulase variants such as those described in WO 94/07998, EP 0 531 315, U.S. Pat. Nos. 5,457,046, 5,686,593, and 5,763,254, WO 95/24471, WO 98/12307 and WO 99/01544.

The cellulase also may be any of the cellulases disclosed in WO 91/17244 and WO 02/099091.

Commercially available cellulases include Celluzyme® produced by a strain of *Humicola insolens*, Carezyme® and Renozyme® (Novozymes A/S), and KAC-500(B)™ (Kao Corporation), Clazinase™, and Puradax HA™ (Genencor International Inc.).

Mannanases

Any mannanase suitable for use in alkaline solutions can be used. Suitable mannanases include those of bacterial or fungal origin. The mannanase may be a chemically or genetically modified mutant.

In an embodiment the mannanase is derived from a strain of *Bacillus*, especially *Bacillus* sp. I633 disclosed in WO 99/64619 or *Bacillus agaradhaerens*, for example from the type strain DSM 8721.

Commercially available mannanases are Purabrite® available from Genencor Inc. and Mannaway® produced by Novozymes A/S.

Pectate Lyases

Any pectate lyase suitable for use in alkaline solutions can be used. Suitable pectate lyases include those of bacterial or fungal origin. The pectate lyase may be a chemically or genetically modified mutant.

In a preferred embodiment the pectate lyase is derived from a strain of *Bacillus*, especially a strain of *Bacillus subtilis*, especially *Bacillus subtilis* DSM 14218 or a variant thereof disclosed in WO 02/92741.

Peroxidases/Oxidases

Peroxidase enzymes are used in combination with hydrogen peroxide or a source thereof (e.g., a percarbonate, perborate or persulfate). Oxidase enzymes are used in combination with oxygen. Both types of enzymes are used for "solution bleaching", i.e., to prevent transfer of a textile dye from a dyed fabric to another fabric when said fabrics are washed together in a wash liquor, preferably together with an enhancing agent as described in e.g., WO 94/12621 and WO 95/01426. Suitable peroxidases/oxidases include those of plant, bacterial or fungal origin. The peroxidase/oxidase may be a chemically or genetically modified mutant. Examples of useful peroxidases include peroxidases from *Coprinus*, e.g., from *C. cinereus*, and variants thereof such as those described in WO 93/24618, WO 95/10602, and WO 98/15257.

Commercially available peroxidases include Guardzyme™ (Novozymes A/S).

Each enzyme is typically incorporated in the detergent composition at a level from 0.000001% to 2% of enzyme protein by weight of the composition, preferably at a level from 0.00001% to 1% of enzyme protein by weight of the composition, more preferably at a level from 0.0001% to 0.5% of enzyme protein by weight of the composition, even more preferably at a level from 0.001% to 0.2% of enzyme protein by weight of the composition.

The enzymes may be added in an amount corresponding to 0.01-100 mg of enzyme protein per liter of wash liquor, preferably 0.05-5 mg of enzyme protein per liter of wash liquor, in particular 0.1-1 mg of enzyme protein per liter of wash liquor.

The detergent enzyme(s) may be included in a detergent composition by adding separate additives containing one or more enzymes, or by adding a combined additive comprising all of these enzymes.

The detergent composition may comprises mixtures of the above mentioned enzymes, in particular a mixture of two, three, four, five, six or more different enzymes, e.g., an amylase, a cellulase, a lipase, and a protease.

Enzyme Stabilization System

The enzyme stabilization system comprises a water-soluble calcium salt, a polyfunctional amino compound, and a low molecular weight carboxylic acid or salt thereof.

Calcium Salts

Any water-soluble calcium salt can be used as a source of calcium ions, including calcium acetate, calcium chloride, calcium chloride dihydrate, calcium formate or calcium propionate. When the calcium salt is calcium formate, it can also serve as the low molecular weight carboxylic acid or salt. The level of calcium ions in the composition is from about 0.1 to about 10 millimoles of calcium ion per liter, preferably from about 0.5 to about 5 millimoles of calcium ion per liter, most preferably from about 0.5 to about 1.5 millimoles of calcium ion per liter.

Polyfunctional Amino Compounds

The polyfunctional amino compounds are aliphatic organic compounds comprising at least one amine grouping and at least two hydroxyl groups. Thus, quaternary ammonium compounds are not included in the term "polyfunctional amino compounds". Examples of polyfunctional amino compounds are polyalkanolamines such as diethanolamine, triethanolamine, di-isopropanolamine, tri-isopropanolamine, and tris(hydroxymethyl)aminomethane. In particular, the polyfunctional amino compound is triethanolamine. In an embodiment, the polyfunctional amino compound is a triethanolamine salt of dodecylbenzene sulfonic acid, which can also act as a surfactant.

The amount of the polyfunctional amino compound used is generally from 0.1-5%, preferably from 0.1-1.5%, by weight of the detergent composition.

Carboxylic Acids

The short chain carboxylic acid or salt thereof is acetic acid, formic acid, propionic acid, or salt thereof. In an embodiment, the carboxylic acid or salt thereof is water-soluble, and is preferably formic acid or a salt thereof, e.g., sodium formate or potassium formate. The short chain carboxylic acid or salt thereof is used at a level from about 0.1% to about 6%, preferably from about 2% to about 4% by weight of the detergent composition.

The enzyme stabilization system may further conventional stabilizing agents, e.g., a polyol such as propylene glycol or glycerol, a sugar or sugar alcohol, or lactic acid.

pH of the Detergent Composition

The pH of the detergent composition is an acidic pH at which the alkaline protease(s) and/or non-proteolytic enzyme(s) are stable, but at which the alkaline protease(s) are virtually inactive, i.e., a pH at which the alkaline protease(s) retain no more than 10% of their optimal activity, such as no more than 9%, no more than 8%, no more than 7%, no more than 6%, no more than 5%, no more than 4%, no more than 3%, no more than 2%, no more than 1%, and preferably none of their activity, as described above. In an embodiment, the pH is from about 4.5 to about 5.5, such as from about 4.7 to about 5.3, and in particular about 4.8 to about 5.1.

Because the alkaline protease retains its stability, but its activity is significantly reduced, the stability of the one or more non-proteolytic enzymes in the detergent composition is greatly increased. As described below, the protease activity is recovered during the wash process by using a pH which is greater than about 7.

Suitable pH buffers include those based on formic acid, citric acid, acetic acid and propionic acid and salts of their corresponding ions such as sodium formate, sodium citrate, sodium acetate, and sodium propionate.

Surfactants

The detergent composition may further comprise a surfactant system comprising one or more surfactants selected from nonionic and/or anionic and/or cationic and/or amphoteric and/or zwitterionic and/or semi-polar surfactants. The surfactants are typically present at a level of from 0.1% to 60% by weight, such as 1% to about 40% by weight, e.g., about 3% to about 25% by weight.

The surfactant system is preferably formulated to be compatible with enzyme components present in the composition. The surfactant system is most preferably formulated in such a way that it promotes, or at least does not degrade, the stability of any enzyme in these compositions.

Preferred surfactant systems to be used according to the present invention comprise one or more nonionic and/or anionic surfactants.

Anionic Surfactants

Anionic surfactants include linear alkylbenzenesulfonate, alpha-olefinsulfonate, alkyl sulfate (fatty alcohol sulfate), alcohol ethoxysulfate, secondary alkanesulfonate, alpha-sulfo fatty acid methyl ester, alkyl- or alkenylsuccinic acid or soap.

Anionic surfactants include alkyl alkoxylated sulfate surfactants. Examples are water soluble salts or acids of the formula $RO(A)_mSO_3M$ wherein R is an unsubstituted $C_{10}$-$C_{24}$ alkyl or hydroxyalkyl group having a $C_{10}$-$C_{24}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium cations and quaternary ammonium cations such as tetramethyl-ammonium and dimethyl piperdinium cations and those derived from alkylamines such as ethylamine, diethylamine, triethylamine, mixtures thereof, and the like. Exemplary surfactants are $C_{12}$-$C_{18}$ alkyl polyethoxylate (1.0) sulfate ($C_{12}$-$C_{18}E(1.0)M$), $C_{12}$-$C_{18}$ alkyl polyethoxylate (2.25) sulfate ($C_{12}$-$C_{18}(2.25)M$, and $C_{12}$-$C_{18}$ alkyl polyethoxylate (3.0) sulfate ($C_{12}$-$C_{18}E(3.0)M$), and $C_{12}$-$C_{18}$ alkyl polyethoxylate (4.0) sulfate ($C_{12}$-$C_{18}E(4.0)M$), wherein M is conveniently selected from sodium and potassium.

Suitable anionic surfactants are alkyl ester sulfonate surfactants including linear esters of $C_8$-$C_{20}$ carboxylic acids (i.e., fatty acids) which are sulfonated with gaseous $SO_3$ according to "The Journal of the American Oil Chemists Society", 1975, 52: 323-329. Suitable starting materials would include natural fatty substances as derived from tallow, palm oil, etc.

Alkyl ester sulfonate surfactants include alkyl ester sulfonate surfactants of the formula:

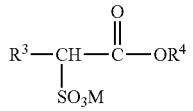

wherein $R^3$ is $C_8$-$C_{20}$ hydrocarbyl, preferably an alkyl, or a combination thereof, $R^4$ is $C_1$-$C_6$ hydrocarbyl, preferably an alkyl, or a combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethonolamine, and triethanolamine. Preferably, $R^3$ is $C_{10}$-$C_{16}$ alkyl, and $R^4$ is methyl, ethyl or isopropyl. Especially preferred are the methyl ester sulfonates wherein $R^3$ is $C_{10}$-$C_{16}$ alkyl.

Other suitable anionic surfactants include the alkyl sulfate surfactants which are water soluble salts or acids of the formula $ROSO_3M$ wherein R preferably is a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12}$-$C_{16}$ are preferred for lower wash temperatures (e.g., below about 50° C.) and $C_{16}$-$C_{18}$ alkyl chains are preferred for higher wash temperatures (e.g., above about 50° C.).

Other anionic surfactants useful for detersive purposes can also be included in the laundry detergent compositions. These include salts (including, for example, sodium, potassium, ammonium, and substituted ammonium salts such as mono-, di- and triethanolamine salts) of soap, $C_8$-$C_{22}$ primary or secondary alkanesulfonates, $C_8$-$C_{24}$ olefinsulfonates, sulfonated polycarboxylic acids prepared by sulfonation of the pyrolyzed product of alkaline earth metal citrates, e.g., as described in British Patent Specification No. 1,082,179, $C_8$-$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinates (especially saturated and unsaturated $C_{12}$-$C_{18}$ monoesters) and diesters of sulfosuccinates (especially saturated and unsaturated $C_6$-$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates such as those of the formula $RO(CH_2CH_2O)_k$—$CH_2COO^-M^+$ wherein R is $C_8$-$C_{22}$ alkyl, k is an integer from 1 to 10, and M is a soluble salt forming cation. Resin acids and hydrogenated resin acids are also suitable, such as rosin, hydrogenated rosin, and resin acids and hydrogenated resin acids present in or derived from tall oil.

In an embodiment, the anionic surfactant is an alkylbenzene sulfonate such as a linear (straight-chain) alkyl benzene sulfonate (LAS) wherein the alkyl group preferably contains from 10 to 18 carbon atoms.

Further examples are described in "Surface Active Agents and Detergents" (Vols. I and II by Schwartz, Perrry and Berch). A variety of such surfactants are also generally disclosed in U.S. Pat. No. 3,929,678 (column 23, line 58 through column 29, line 23, herein incorporated by reference).

Nonionic Surfactants

Nonionic surfactants include alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides").

Polyethylene, polypropylene, and polybutylene oxide condensates of alkyl phenols are suitable for use as the nonionic surfactant, with the polyethylene oxide condensates being preferred. These compounds include the condensation products of alkyl phenols having an alkyl group containing from about 6 to about 14 carbon atoms, preferably from about 8 to about 14 carbon atoms, in either a straight chain or branched-chain configuration with the alkylene oxide. In a preferred embodiment, the ethylene oxide is present in an amount equal to from about 2 to about 25 moles, more preferably from about 3 to about 15 moles, of ethylene oxide per mole of alkyl phenol. Commercially available nonionic surfactants of this type include Igepal™ CO-630, marketed by the GAF Corporation; Surfonic N-95 from Huntsman; and Triton™ X-45, X-114, X-100 and X-102, all marketed by the Rohm & Haas Company. These surfactants are commonly referred to as alkylphenol alkoxylates (e.g., alkyl phenol ethoxylates).

The condensation products of primary and secondary aliphatic alcohols with about 1 to about 25 moles of ethylene oxide are suitable nonionic surfactants. The alkyl chain of the aliphatic alcohol can either be straight or branched, primary or secondary, and generally contains from about 8 to about 22 carbon atoms. Preferred are the condensation products of alcohols having an alkyl group containing from about 8 to about 20 carbon atoms, more preferably from about 8 to about 18 carbon atoms, with from about 2 to about 10 moles of ethylene oxide per mole of alcohol. About 2 to about 9 moles of ethylene oxide and most preferably from 3 to 7 moles of ethylene oxide per mole of alcohol are present in said condensation products. Examples of commercially available nonionic surfactants of this type include Tergitol™ 15-S-9 (the condensation product of $C_{11}$-$C_{15}$ linear alcohol with 9 moles ethylene oxide), Tergitol™ 24-L-6 NMW (the condensation product of $C_{12}$-$C_{14}$ primary alcohol with 6 moles ethylene oxide with a narrow molecular weight distribution), both marketed by Union Carbide Corporation; Neodol™ 45-9 (the condensation product of $C_{14}$-$C_{15}$ linear alcohol with 9 moles of ethylene oxide), Neodol™ 23-3 (the condensation product of $C_{12}$-$C_{13}$ linear alcohol with 3.0 moles of ethylene oxide), Neodol™ 45-7 (the condensation product of $C_{14}$-$C_{15}$ linear alcohol with 7 moles of ethylene oxide), Neodol™ 45-5 (the condensation product of $C_{14}$-$C_{15}$ linear alcohol with 5 moles of ethylene oxide), Neodol™ N25-3, Neodol™ N91-2.5, marketed by Shell Chemical Company, Kyro™ EOB (the condensation product of $C_{13}$-$C_{15}$ alcohol with 9 moles ethylene oxide), marketed by The Procter & Gamble Company, and Genapol LA 050 (the condensation product of $C_{12}$-$C_{14}$ alcohol with 5 moles of ethylene oxide) marketed by Hoechst, and Stepanol N25-7 and Stepanol N25-3, marketed by Stepan.

Other nonionic surfactants are alkylpolysaccharides disclosed in U.S. Pat. No. 4,565,647, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4-, and/or 6-position, preferably predominantly the 2-position.

The condensation products of ethylene oxide with a hydrophobic base formed by the condensation of propylene oxide with propylene glycol are also suitable for use as the additional nonionic surfactant systems. The hydrophobic portion of these compounds will preferably have a molecular weight from about 1,500 to about 1,800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic™ surfactants, marketed by BASF.

The nonionic surfactant of the nonionic surfactant system may also be the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2,500 to about 3,000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.

Other nonionic surfactants are polyhydroxy fatty acid amide surfactants of the formula

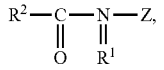

wherein $R^1$ is H, or $R^1$ is $C_{1-4}$ hydrocarbyl, 2-hydroxyethyl, 2-hydroxypropyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is straight $C_{11-15}$ alkyl or $C_{16-18}$ alkyl or alkenyl chain such as coconut alkyl or mixtures thereof, and Z is derived from a reducing sugar such as glucose, fructose, maltose or lactose, in a reductive amination reaction.

Cationic Surfactants

Cationic detersive surfactants suitable for use in the laundry detergent compositions are those having one long-chain hydrocarbyl group. Examples of such cationic surfactants include the ammonium surfactants such as alkyltrimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected form the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$-$C_4$ alkyl, $C_1$-$C_4$ hydroxyalkyl, benzyl ring structures formed by joining the two $R^4$ groups, —$CH_2CHOHCHOHCOR^6CHOHCH_2OH$, wherein $R^6$ is any hexose or hexose polymer having a molecular weight less than about 1,000, and hydrogen when y is not 0; $R^5$ is the same as $R^4$ or is an alkyl chain, wherein the total number of carbon atoms of $R^2$ plus $R^5$ is not more than about 18; each y is from 0 to about 10, and the sum of the y values is from 0 to about 15; and X is any compatible anion.

Cationic surfactants include the water soluble quaternary ammonium compounds useful in the present composition having the formula:

$$R_1R_2R_3R_4N^+X^- \quad \text{(i)}$$

wherein $R_1$ is $C_8$-$C_{16}$ alkyl, each of $R_2$, $R_3$ and $R_4$ is independently $C_1$-$C_4$ alkyl, $C_1$-$C_4$ hydroxy alkyl, benzyl, and —$(C_2H_{40})_xH$ where x has a value from 2 to 5, and X is an anion. Not more than one of $R_2$, $R_3$ or $R_4$ should be benzyl.

The preferred alkyl chain length for $R_1$ is $C_{12}$-$C_{15}$, particularly where the alkyl group is a mixture of chain lengths derived from coconut or palm kernel fat or is derived synthetically by olefin build up or OXO alcohols synthesis.

Preferred groups for $R_2$ $R_3$ and $R_4$ are methyl and hydroxyethyl groups and the anion X may be selected from halide, methosulphate, acetate and phosphate ions.

Examples of suitable quaternary ammonium compounds of formulae (i) are:

coconut trimethyl ammonium chloride or bromide;

coconut methyl dihydroxyethyl ammonium chloride or bromide;

decyl triethyl ammonium chloride;

decyl dimethyl hydroxyethyl ammonium chloride or bromide;

$C_{12-15}$ dimethyl hydroxyethyl ammonium chloride or bromide;

coconut dimethyl hydroxyethyl ammonium chloride or bromide;

myristyl trimethyl ammonium methyl sulphate;

lauryl dimethyl benzyl ammonium chloride or bromide;

lauryl dimethyl(ethenoxy)$_4$ ammonium chloride or bromide;

choline esters (compounds of formula (i) wherein $R_1$ is

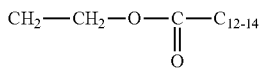

alkyl and $R_2$, $R_3$, and $R_4$ are methyl).

di-alkyl imidazolines [compounds of formula (i)].

Other cationic surfactants are described in U.S. Pat. No. 4,228,044 and EP 0 000 224.

Amphoteric Surfactants

Amphoteric surfactants are also suitable for use in the detergent compositions. These surfactants can be broadly described as aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 (column 19, lines 18-35) for examples of amphoteric surfactants.

Zwitterionic Surfactants

Zwitterionic surfactants are also suitable for use in detergent compositions. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 (column 19, line 38 through column 22, line 48) for examples of zwitterionic surfactants.

Semi-Polar Nonionic Surfactants

Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety from about 10 to about 18 carbon atoms and a moiety selected from the group consisting of alkyl and hydroxyalkyl moieties of from about 1 to about 3 carbon atoms.

Semi-polar nonionic surfactants include the amine oxide surfactants having the formula:

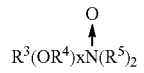

$$R^3(OR^4)xN(R^5)_2 \rightarrow O$$

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3: and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{12}$ alkoxy ethyl dihydroxy ethyl amine oxides.

Many commercial liquid laundry detergents containing enzymes use more expensive surfactants such as alcohol ether sulfates and alkylpolyglycosides mainly because they are considered to be enzyme friendly.

The surfactant system can reduce the cost of detergent compositions of the present invention by reducing or eliminating the use of expensive surfactants. Thus, in an embodiment, the surfactant system is free of alcohol ether sulfates and alkylpolyglycosides.

In order to reduce the cost, the surfactant system consists of a neutralized form of dodecylbenzene sulfonic acid, e.g., a sodium salt or triethanolamine salt of dodecylbenzene sulfonate and/or nonylphenol ethoxylate. These surfactants are two of the most effective and inexpensive commercially available surfactants. In another embodiment, the surfactant system consists of a neutralized form of dodecylbenzene sulfonic acid, e.g., a sodium salt or triethanolamine salt of dodecylbenzene sulfonate. In another embodiment, the surfactant system consists of an alcohol ethoxylate alone or with dodecylbenzene sulfonic acid, e.g., a sodium salt or triethanolamine salt of dodecylbenzene sulfonate, or nonylphenol ethoxylate. In another embodiment, the surfactant system consists of nonylphenol ethoxylate, alcohol ethoxylate, and dodecylbenzene sulfonic acid, e.g., a sodium salt or triethanolamine salt of dodecylbenzene sulfonate.

The balance of the composition is usually water, but the composition can contain other ingredients, including perfumes, dyes, opacifiers, optical brighteners, suds suppressors, pH adjusting agents, etc. Disclosures of suitable ingredients can be found in the patents and patent applications incorporated herein by reference.

Suds Suppressors

The detergent composition may further comprise a suds suppressor such as silicones and silica-silicone mixtures. Silicones can generally be represented by alkylated polysiloxane materials, while silica is normally used in finely divided forms exemplified by silica aerogels and xerogels and hydrophobic silicas of various types. Theses materials can be incorporated as particulates, in which the suds suppressor is advantageously releasably incorporated in a water-soluble or water-dispersible, substantially non surface-active detergent impermeable carrier. Alternatively the suds suppressor can be dissolved or dispersed in a liquid carrier and applied by spraying onto one or more of the other components.

An example of a silicone suds controlling agent is disclosed in U.S. Pat. No. 3,933,672. Other suds suppressors are the self-emulsifying silicone suds suppressors described in German Application No. DTOS 2,646,126. An example of such a compound is DC-544, commercially available form Dow Corning, which is a siloxane-glycol copolymer. Especially preferred suds controlling agent are the suds suppressor system comprising a mixture of silicone oils and 2-alkyl-alkanols. Suitable 2-alkyl-alkanols are 2-butyl-octanols, which are commercially available under the trade name Isofol 12 R.

Such suds suppressor systems are described in EP 0 593 841.

Especially preferred silicone suds controlling agents are described in European Application No. 92201649.8. The compositions can comprise a silicone/silica mixture in combination with fumed nonporous silica such as Aerosil®.

The suds suppressors described above are normally employed at levels of from 0.001% to 2% by weight of the composition, preferably from 0.01% to 1% by weight.

Softening Agents

The detergent composition may further comprise a fabric softening agent. These agents may be inorganic or organic. Inorganic softening agents include the smectite clays disclosed in British Patent No. 1,400,898 and in U.S. Pat. No. 5,019,292. Organic fabric softening agents include the water insoluble tertiary amines as disclosed in British Patent No. 514,276 and EP 0 011 340, and their combination with mono $C_{12}$-$C_{14}$ quaternary ammonium salts are disclosed in EP 0 026 528 and di-long-chain amides as disclosed in EP 0 242 919. Other useful organic ingredients of fabric softening systems include high molecular weight polyethylene oxide materials as disclosed in EP 0 299 575 and 0 313 146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or di-long chain amide materials are incorporated at levels of from 0.5% to 5% by weight, normally from 1% to 3% by weight, whereas the high molecular weight polyethylene oxide materials and the water soluble cationic materials are added at levels of from 0.1% to 2%, normally from 0.15% to 1.5% by weight. These materials are normally added to the spray dried portion of the composition, although in some instances it may be more convenient to add them as a dry mixed particulate, or spray them as molten liquid on to other solid components of the composition.

Polymeric Dye-Transfer Inhibiting Agents

The detergent compositions according to the present invention may also comprise from 0.001% to 10%, preferably from 0.01% to 2%, more preferably form 0.05% to 1% by weight of polymeric dye-transfer inhibiting agents. Said polymeric dye-transfer inhibiting agents are normally incorporated into detergent compositions in order to inhibit the transfer of dyes from colored fabrics onto fabrics washed therewith. These polymers have the ability of complexing or adsorbing the fugitive dyes washed out of dyed fabrics before the dyes have the opportunity to become attached to other articles in the wash.

Especially suitable polymeric dye-transfer inhibiting agents are polyamine N-oxide polymers, copolymers of N-vinyl-pyrrolidone and N-vinylimidazole, polyvinylpyrrolidone polymers, polyvinyloxazolidones and polyvinylimidazoles or mixtures thereof.

Addition of such polymers also enhances the performance of the enzymes according the invention.

The detergent may comprise one or more polymers. Examples are carboxymethylcellulose, poly(vinylpyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid copolymers.

Other Components

The detergent composition may also contain other conventional detergent ingredients such as, e.g., soil-releasing agents, abrasives, bactericides, tarnish inhibitors, fabric conditioners including clays, foam boosters, anti-corrosion agents, soil-suspending agents, anti-soil redeposition agents, dyes, bactericides, optical brighteners, hydrotropes, tarnish inhibitors, or perfumes.

Especially suitable encapsulating materials are water soluble capsules which consist of a matrix of polysaccharide and polyhydroxy compounds such as described in British Patent No. 1,464,616.

Other suitable water soluble encapsulating materials comprise dextrins derived from ungelatinized starch acid esters of substituted dicarboxylic acids such as described in U.S. Pat. No. 3,455,838. These acid-ester dextrins are, preferably, prepared from such starches as waxy maize, waxy sorghum, sago, tapioca and potato. Suitable examples of said encapsulation materials include N-Lok manufactured by National Starch. The N-Lok encapsulating material consists of a modified maize starch and glucose. The starch is modified by adding monofunctional substituted groups such as octenyl succinic acid anhydride.

Typical anti-redeposition agents used in detergents include water-soluble, generally organic colloids, including for example the water-soluble salts of polymeric carboxylic acids such as polyacrylic acid or polymaleic acid or co-polymers thereof, glue, gelatine, salts of ether carboxylic acids or ether sulfonic acids of starch or cellulose or salts of sulfuric acid esters of cellulose or starch. Water-soluble polyamides containing acidic groups are also used as anti-redeposition agent. Soluble starch preparations and other starch products than those mentioned above, for example partly hydrolyzed starch, may also be used. Sodium carboxymethyl cellulose, methyl cellulose, hydroxyethyl cellulose, methyl hydroxyethyl cellulose and mixtures thereof are preferably used. These materials are normally used at levels of from 0.05% to 10%, more preferably form 0.2% to 8%, most preferably from 0.5% to 6% by weight of the composition.

Preferred optical brighteners are anionic in character, examples of which are disodium 4,4'-bis-(2-diethanolamino-4-anilino-s-triazin-6-ylamino)stilbene-2:2'-disulphonate, disodium 4,4'-bis-(2-morpholino-4-anilino-s-triazin-6-ylamino)stilbene-2:2'-disulphonate, disodium 4,4'-bis-(2,4-dianilino-s-triazin-6-ylamino)stilbene-2:2'-disulphonate, monosodium 4',4"-bis-(2,4-dianilino-s-triazin-6-ylamino) stilbene-2-sulphonate, disodium 4,4'-bis-(2-anilino-4-(N-methyl-N-2-hydroxyethylamino)-s-triazin-6-ylamino)stilbene-2,2'-disulphonate, disodium 4,4'-bis-(4-phenyl-2,1,3-triazol-2-yl)stilbene-2,2'-disulphonate, disodium 4,4'-bis-(2-anilino-4-(1-methyl-2-hydroxyethylamino)-s-triazin-6-ylamino)stilbene-2,2'-disulphonate, sodium 2-stilbyl-4"-(naphtho-1',2':4,5)-1,2,3-triazole-2"-sulphonate, and 4,4'-bis-(2-sulphostyryl)biphenyl.

Other useful polymeric materials are the polyethylene glycols, particularly those of molecular weight 1,000-10,000, more particularly 2,000 to 8,000 and most preferably about 4,000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Soil release agents useful in detergent compositions are conventionally copolymers or terpolymers of terephthalic acid with ethylene glycol and/or propylene glycol units in various arrangements. Examples of such polymers are disclosed in U.S. Pat. Nos. 4,116,885 and 4,711,730 and EP 0 272 033. A particular preferred polymer in accordance with EP 0 272 033 has the formula:

$$(CH_3(PEG)_{43})_{0.75}(POH)_{0.25}[T\text{-}PO)_{2.8}(T\text{-}PEG)_{0.4}]T$$
$$(POH)_{0.25}((PEG_{43}CH_3)_{0.75}$$

where PEG is —$(OC_2H_4)O$—, PO is $(OC_3H_6O)$ and T is $(POOC_6H_4CO)$.

Also very useful are modified polyesters as random copolymers of dimethyl terephthalate, dimethyl sulfoisophthalate, ethylene glycol and 1,2-propanediol, the end groups consisting primarily of sulphobenzoate and secondarily of mono esters of ethylene glycol and/or 1,2-propanediol. The target is to obtain a polymer capped at both ends by sulphobenzoate groups, primarily, in the present context most of said copolymers herein will be endcapped by sulphobenzoate groups. However, some copolymers will be less than fully capped, and therefore their end groups may consist of monoester of ethylene glycol and/or 1,2-propanediol, thereof consist "secondarily" of such species.

The selected polyesters herein contain about 46% by weight of dimethyl terephthalic acid, about 16% by weight of 1,2-propanediol, about 10% by weight ethylene glycol, about 13% by weight of dimethyl sulfobenzoic acid and about 15% by weight of sulfoisophthalic acid, and have a molecular weight of about 3.000. The polyesters and their method of preparation are described in detail in EP 0 311 342.

Use of Detergent Composition

The detergent composition is useful for household or industrial laundering of textiles and garments, and in a process for machine wash treatment of fabrics comprising treating the fabrics during one or more washing cycle of a machine washing process with the detergent composition.

The detergent composition is also useful for household or industrial dish or cutlery or other hard surface washing, and in a process for treatment of dishes, cutlery etc. comprising washing with the detergent composition.

Household laundry processes are carried out under a range of conditions. Commonly, the washing time is from 5 to 60 minutes and the washing temperature is in the range 10-60° C., most commonly from 20-40° C. Prolonged soaking is commonly used. The washing solution has a pH of at least 7 such as a pH of 7-11.5. By using a pH which is greater than about 7 during the wash process, the protease activity is recovered.

For example, a pH of at least 7 can be obtained by washing with some tap waters. Alternatively, in an industrial laundry process, a builder system or bleaching agent that increases the pH of the wash bath can be added separately from the liquid detergent composition.

Builder Systems

Any conventional builder system is suitable including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used.

Other detergent builders or complexing agents include zeolite, diphosphate, triphosphate, phosphonate, carbonate, citrate, nitrilotriacetic acid, ethylenediaminetetraacetic acid, diethylenetriaminepentaacetic acid, alkyl- or alkenylsuccinic acid, soluble silicates or layered silicates (e.g., SKS-6 from Hoechst).

Suitable builders can be an inorganic ion exchange material, commonly an inorganic hydrated aluminosilicate material, more particularly a hydrated synthetic zeolite such as hydrated zeolite A, X, B, HS or MAP.

Another suitable inorganic builder material is layered silicate, e.g., SKS-6 (Hoechst). SKS-6 is a crystalline layered silicate consisting of sodium silicate ($Na_2Si_2O_5$).

Suitable polycarboxylates containing one carboxy group include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy)diacetic acid, maleic acid, diglycollic acid, tartaric acid, tartronic acid and fumaric acid, as well as the ether carboxylates described in DE Patent Nos. 2,446,686, and 2,446,487, U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in Dutch Application No. 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2,-ethane tetracarboxylates, 1,1,3,3-propane tetracarboxylates containing sulfo substituents include the sulfosuccinate derivatives disclosed in British Patent Nos. 1,398,421 and 1,398,422 and in U.S. Pat. No. 3,936,448, and the sulfonated pyrolyzed citrates described in British Patent No. 1,082,179, while polycarboxylates containing phosphone substituents are disclosed in British Patent No. 1,439,000.

Alicyclic and heterocyclic polycarboxylates include cyclopentane-cis, cis-cis-tetracarboxylates, cyclopentadienide pentacarboxylates, 2,3,4,5-tetrahydro-furan-cis,cis,cis-tetracarboxylates, 2,5-tetrahydro-furan-cis-discarboxylates, 2,2,5,5,-tetrahydrofuran-tetracarboxylates, 1,2,3,4,5,6-hexanehexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

Preferred builder systems for use in the present compositions include a mixture of a water-insoluble aluminosilicate builder such as zeolite A or of a layered silicate (SKS-6), and a water-soluble carboxylate chelating agent such as citric acid.

A suitable chelant is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt thereof. Examples of such preferred sodium salts of EDDS include $Na_2$EDDS and $Na_4$EDDS. Examples of such preferred magnesium salts of EDDS include MgEDDS and $Mg_2$EDDS. The magnesium salts are the most preferred for inclusion in compositions in accordance with the invention.

Other builder materials that can form part of the builder system include inorganic materials such as alkali metal carbonates, bicarbonates, silicates, and organic materials such as the organic phosphonates, amino polyalkylene phosphonates and amino polycarboxylates.

Other suitable water-soluble organic salts are the homo- or co-polymeric acids or their salts, in which the polycarboxylic acid comprises at least two carboxyl radicals separated form each other by not more than two carbon atoms.

Polymers of this type are disclosed in British Patent No. 1,596,756. Examples of such salts are polyacrylates of MW 2,000-5,000 and their copolymers with maleic anhydride, such copolymers having a molecular weight of from 20,000 to 70,000, especially about 40,000.

The builder is normally added to the wash bath in an amount of from 5% to 80% by weight of the composition. Preferred levels of the builder are from 5% to 30%.

Bleaching Agents

Suitable bleaching agents include perborate PB1, PB4 and percarbonate. These bleaching agent components can include one or more oxygen bleaching agents and, depending upon the bleaching agent chosen, one or more bleach activators. Present oxygen bleaching compounds will typically be present at levels of from about 1% to about 25%.

The bleaching agent component can be any of the bleaching agents useful for detergent compositions including oxygen bleaches as well as others known in the art.

The bleaching system may comprise a $H_2O_2$ source such as perborate or percarbonate which may be combined with a peracid-forming bleach activator such as tetraacetylethylenediamine or nonanoyloxybenzenesulfonate. Commonly used bleaches are sodium perborate, sodium percarbonate and hydrogen peroxide. Alternatively, the bleaching system may comprise peroxyacids of, e.g., the amide, imide, or sulfone type.

The bleaching agent can be an activated or non-activated bleaching agent.

One category of oxygen bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, EP 0 133 354 and U.S. Pat. No. 4,412,934. Highly preferred bleaching agents also include 6-nonylamino-6-oxoperoxycaproic acid as described in U.S. Pat. No. 4,634,551.

Another category of bleaching agents is halogen bleaching agents. Examples of hypohalite bleaching agents, for example, include trichloro isocyanuric acid and the sodium and potassium dichloroisocyanurates and N-chloro and N-bromo alkane sulphonamides. Such materials are normally added at 0.5-10% by weight of the finished product, preferably 1-5% by weight. Such halogen bleaching agents are generally less preferred for use in enzymatic detergents.

The hydrogen peroxide releasing agents can be used in combination with bleach activators such as tetra-acetylethylenediamine (TAED), nonanoyloxybenzenesulfonate (NOBS, described in U.S. Pat. No. 4,412,934), 3,5-trimethyl-hexsanoloxybenzenesulfonate (ISONOBS, described in EP 0 120 591) or pentaacetylglucose (PAG), which are perhydrolyzed to form a peracid as the active bleaching species, leading to improved bleaching effect. In addition, very suitable are the bleach activators C8 (6-octanamido-caproyl)oxybenzene-sulfonate, C9 (6-nonanamido caproyl)oxybenzene-sulfonate and C10 (6-decanamido caproyl)oxybenzene-sulfonate or mixtures thereof. Also suitable activators are acylated citrate esters such as disclosed in European Application No. 91870207.7.

Bleaching agents include peroxyacids and bleaching systems comprising bleach activators and peroxygen bleaching compounds are described in U.S. Pat. No. 5,677,272.

The hydrogen peroxide may also be present by adding an enzymatic system (i.e., an enzyme and a substrate therefore) which is capable of generation of hydrogen peroxide at the beginning or during the washing and/or rinsing process. Such enzymatic systems are disclosed in EP 0 537 381.

Bleaching agents other than oxygen bleaching agents are also known in the art and can be utilized herein. One type of non-oxygen bleaching agent of particular interest includes photoactivated bleaching agents such as the sulfonated zinc and/or aluminium phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718.

Bleaching agents include a manganese catalyst. The manganese catalyst may, e.g., be one of the compounds described in "Efficient manganese catalysts for low-temperature bleaching", *Nature,* 1994, 369: 637-639.

The following examples are given as exemplary of the invention but without intending to limit the same.

EXAMPLES

Materials

For the following examples, acceptable enzyme stability for an enzyme is having at least 60% residual activity when stored for eight weeks at 30° C.

Example 1

A formulation (CEDW5-51) having the composition set forth in Table 1 was prepared. The pH was 5.08.

TABLE 1

| | WT. % |
|---|---|
| DI water | 60.705 |
| Ethanol 95% | 6.000 |
| Sodium formate | 4.000 |
| BIO-SOFT S-101 | 2.604 |
| TEA | 0.651 |
| SURFONIC N-95 | 22.500 |
| 10% calcium chloride dihydrate | 0.200 |
| LIPEX 100L (a lipase product available from Novozymes) | 1.670 |
| SAVINASE 16L (an alkaline protease product available from Novozymes | 1.670 |

Figure 2:
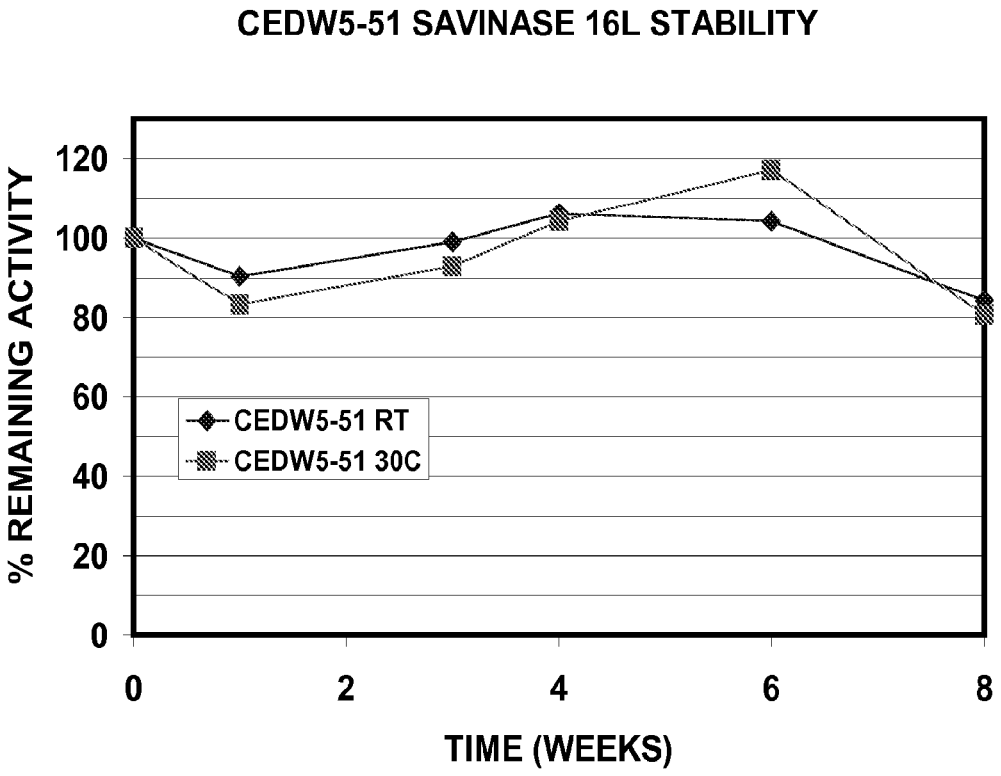
FIG. 2 shows the enzyme stability for an alkaline protease in a detergent composition described in Example 1.

The enzyme stability results are given in FIG. 1 for Lipex 100L and in FIG. 2 for Savinase 16L. The percent remaining activity is above 60% at both temperatures, and at 30° C. it is 66.75% after eight weeks. Savinase 16 L has good stability, and therefore CEDW5-51 is an acceptable liquid laundry formulation. The formulation is phase stable up to a temperature of at least 35° C.

Example 2

A formulation (MGAE5-64) having the composition set forth in Table 2 was prepared. The pH was 4.88.

TABLE 2

| | WT. % |
|---|---|
| DI water | 60.705 |
| Ethanol 95% | 6.000 |
| Sodium formate | 4.000 |
| BIO-SOFT S-101 | 2.604 |
| TEA | 0.651 |
| BIO-SOFT N25-7 | 22.500 |
| 10% calcium chloride dihydrate | 0.200 |
| LIPEX 100L | 1.670 |
| SAVINASE 16L | 1.670 |

Figure 3:
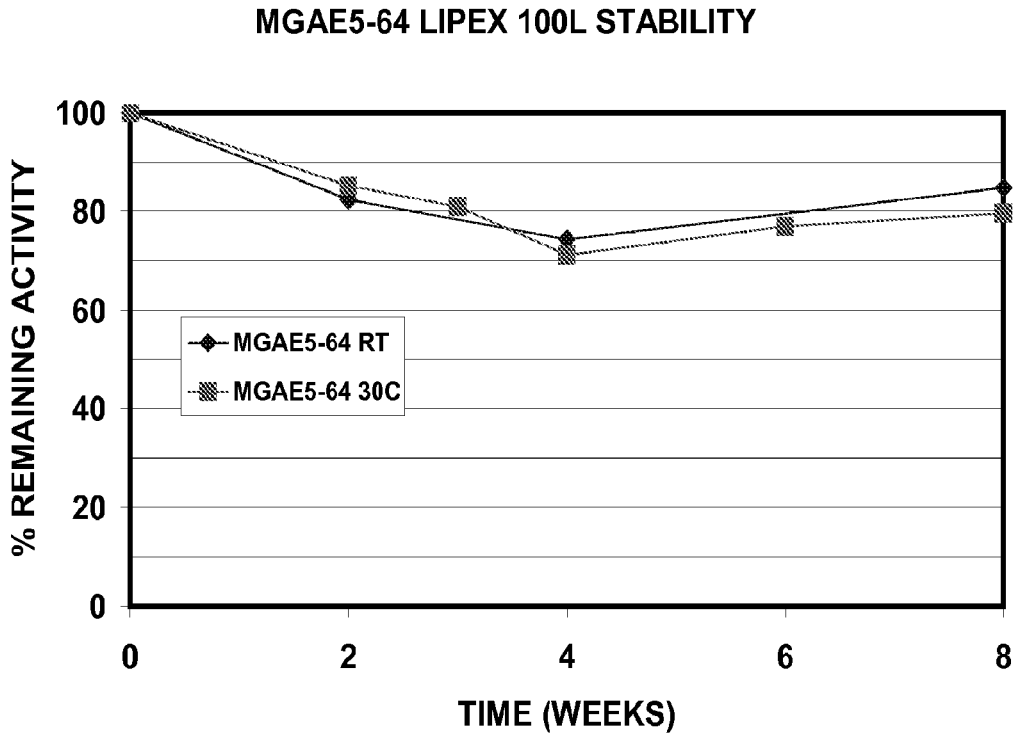
FIG. 3 shows the enzyme stability for a lipase in a detergent composition described in Example 2.
Figure 4:
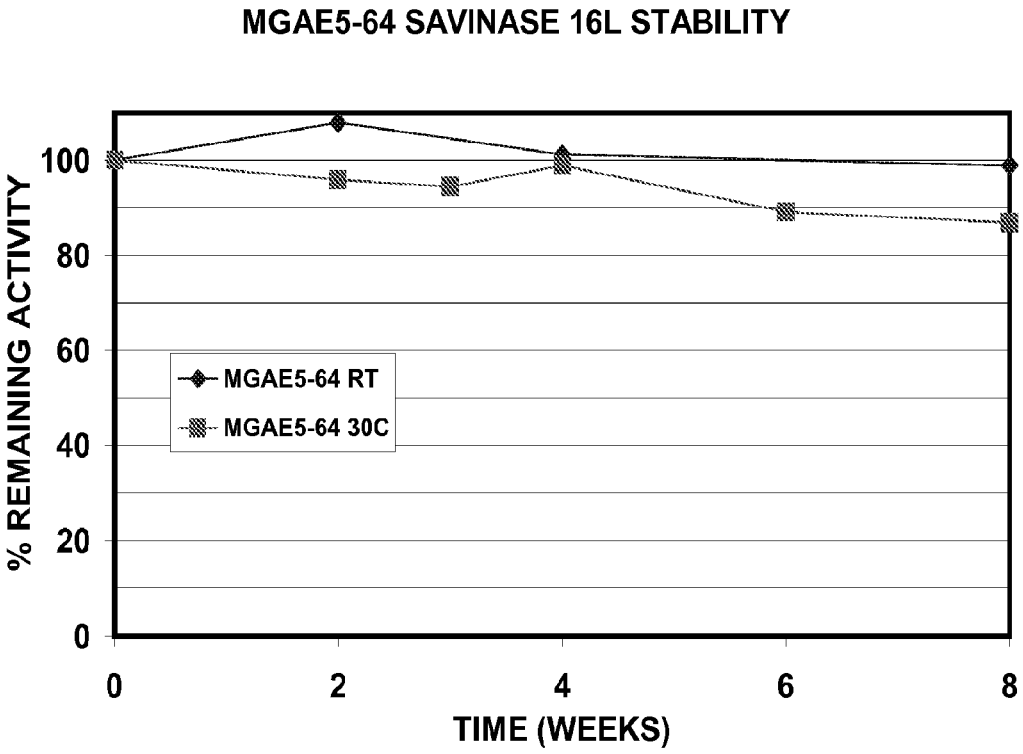
FIG. 4 shows the enzyme stability for an alkaline protease in a detergent composition described in Example 2.

The enzyme stability results are given in FIG. 3 (Lipex 100L) and FIG. 4 (Savinase 16L). Both Lipex 100L and Savinase 16L have good enzyme stability, and therefore MGAE5-64 is an acceptable liquid laundry formulation. The formulation is phase stable up to a temperature of at least 35° C.

Example 3

A formulation (CEDW5-79) including Stainzyme 12L (an alpha-amylase product available from Novozymes), Savinase 16L and Lipex 100L was prepared. The formulation is given in Table 3. The pH was 4.92.

TABLE 3

| | WT. % |
|---|---|
| DI water | 59.035 |
| Ethanol 95% | 6.000 |
| Sodium formate | 4.000 |
| BIO-SOFT S-101 | 2.604 |
| TEA | 0.651 |
| SURFONIC N-95 | 22.500 |
| 10% calcium chloride dihydrate | 0.200 |
| LIPEX 100L | 1.670 |
| SAVINASE 16L | 1.670 |
| STAINZYME 16L | 1.670 |

Figure 5:
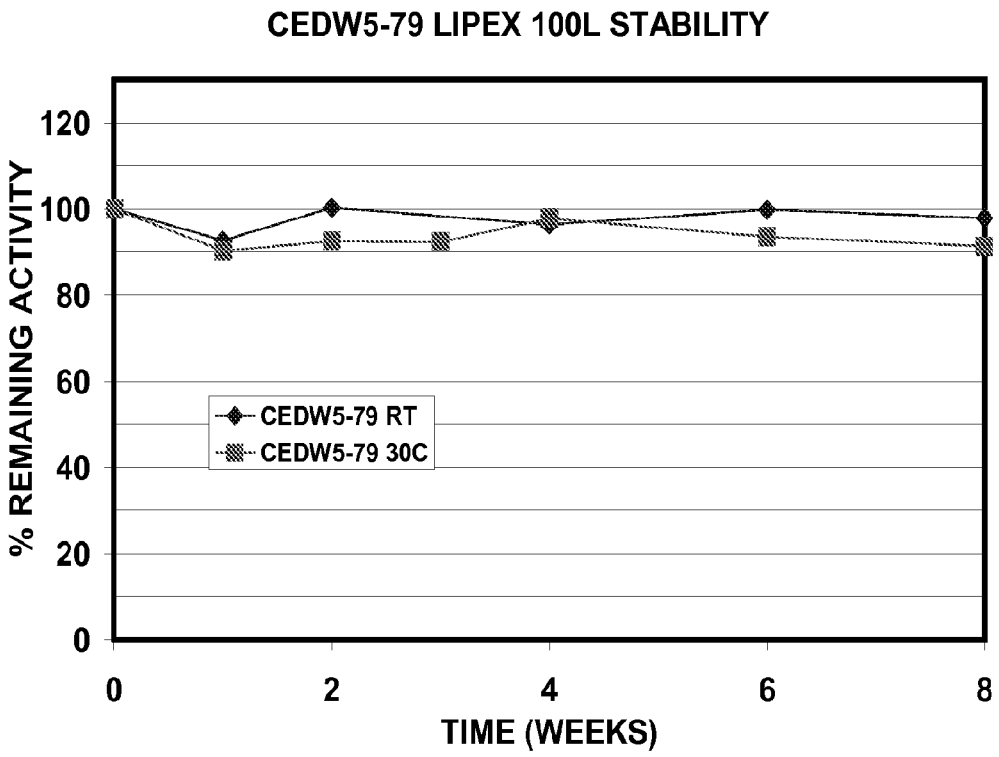
FIG. 5 shows the enzyme stability for a lipase in a detergent composition described in Example 3.
Figure 6:
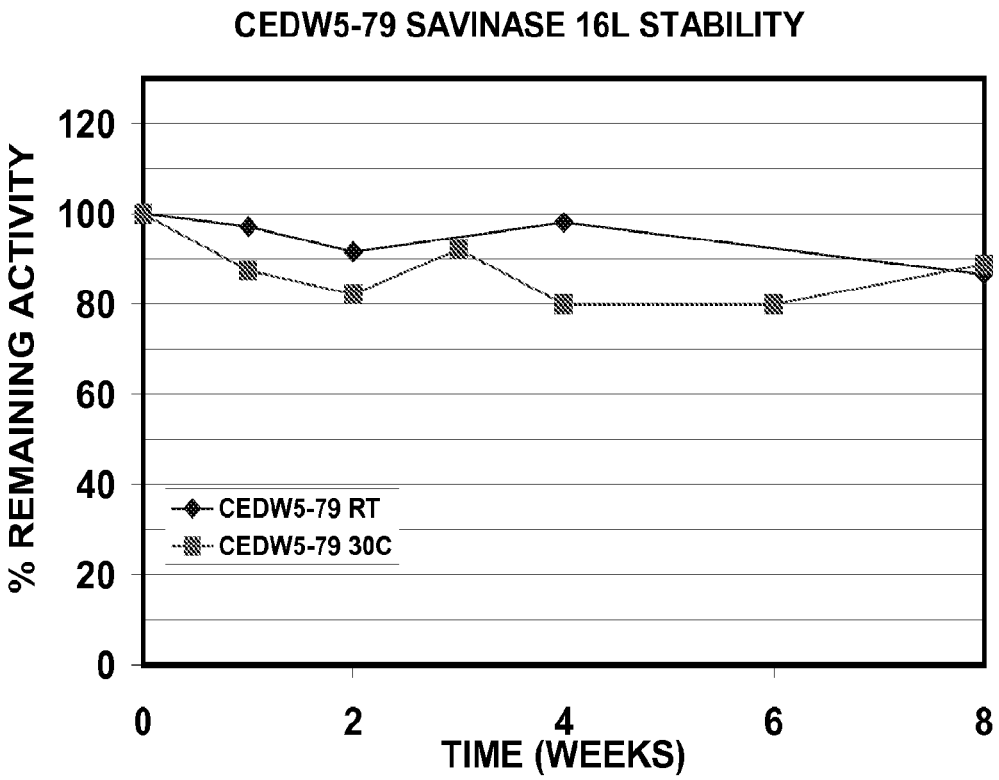
FIG. 6 shows the enzyme stability for an alkaline protease in a detergent composition described in Example 3.
Figure 7:
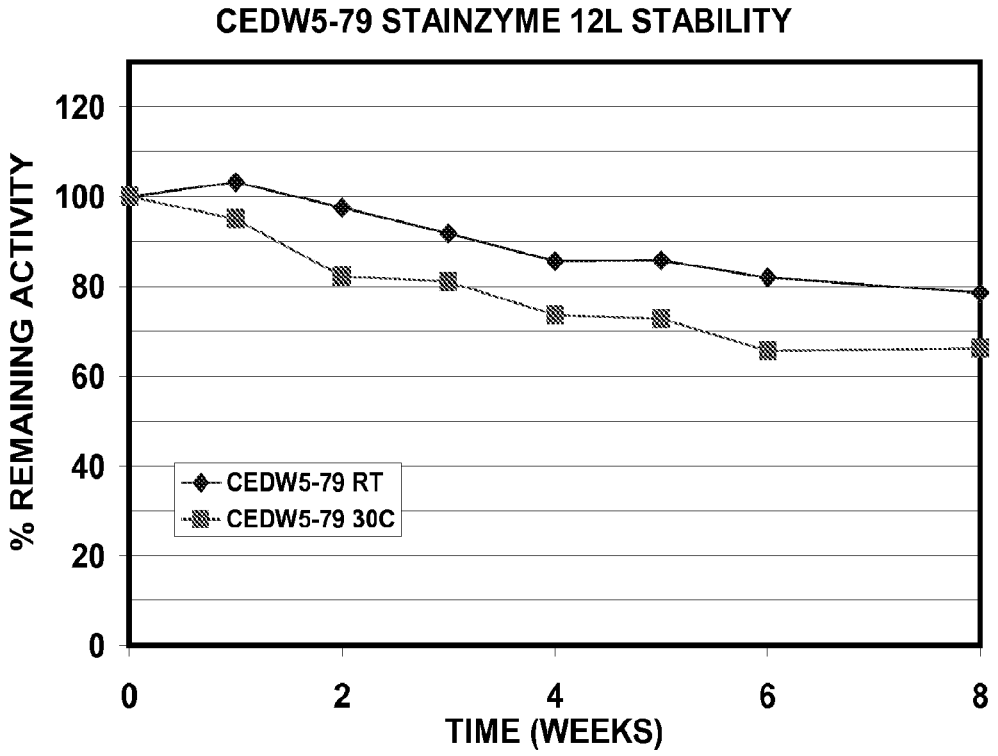
FIG. 7 shows the enzyme stability for an amylase in a detergent composition described in Example 3.

The enzyme stability results for CEDW5-79 are given in FIG. 5 (Lipex 100L), FIG. 6 (Savinase 16L), and FIG. 7 (Stainzyme 12L). All three enzymes exhibit good stability, and therefore CEDW5-79 is an acceptable liquid laundry formulation. The formulation is phase stable up to a temperature of at least 35° C.

Example 4

A formulation (CEDW5-71) including Savinase 16L and Lipex 100L but containing only 15 percent total surfactant was prepared. The composition of this formulation is provided in Table 4. The pH was 4.95.

TABLE 4

| | WT. % |
|---|---|
| DI water | 74.007 |
| Ethanol 95% | 3.000 |
| Sodium formate | 4.000 |
| BIO-SOFT S-101 | 1.563 |
| TEA | 0.391 |
| SURFONIC N-95 | 13.500 |
| 10% calcium chloride dihydrate | 0.200 |
| LIPEX 100L | 1.670 |
| SAVINASE 16L | 1.670 |

Figure 8:
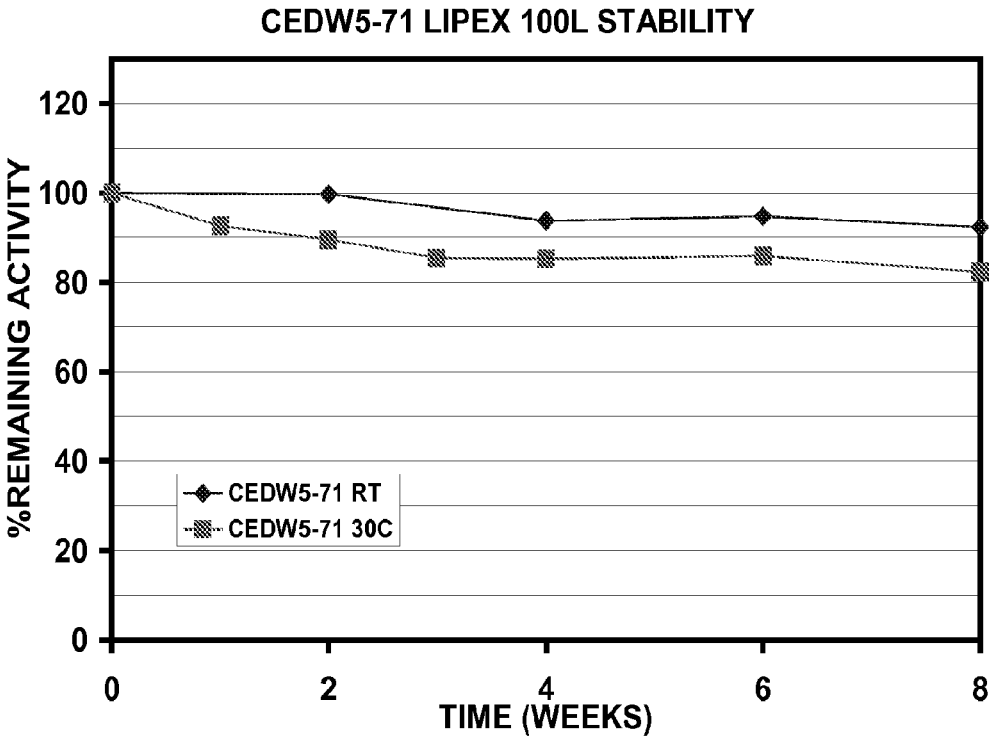
FIG. 8 shows the enzyme stability for a lipase in a detergent composition described in Example 4.
Figure 9:
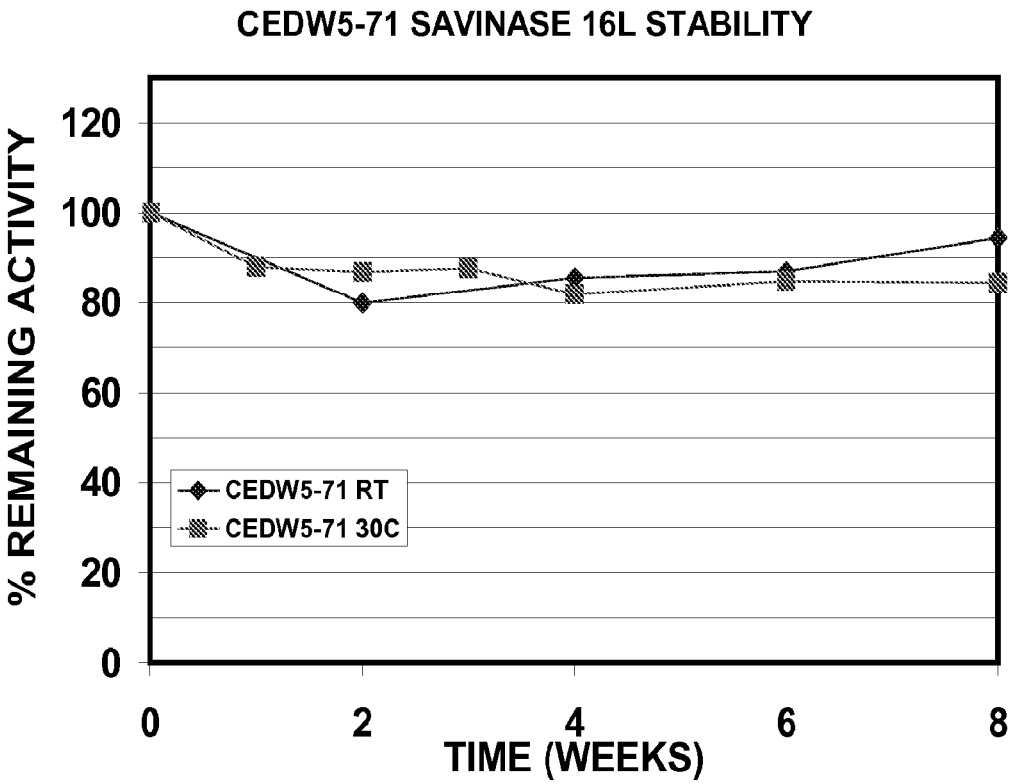
FIG. 9 shows the enzyme stability for an alkaline protease in a detergent composition described in Example 4.

The enzyme stability results for CEDW5-71 are given in FIG. 8 (Lipex 100L) and FIG. 9 (Savinase 16L). Both enzymes have good stability, and therefore CEDW5-71 is an acceptable liquid laundry detergent. The formulation is phase stable up to a temperature of at least 35° C.

Example 5

Another formulation (CEDW5-58) was prepared in an attempt to reduce the cost increase resulting from the inclusion of enzymes. The composition of this formulation is provided in Table 5. The pH was 5.04.

TABLE 5

| | WT. % |
|---|---|
| DI water | 72.856 |
| Sodium formate | 3.000 |
| BIO-SOFT S-101 | 2.083 |
| TEA | 0.521 |
| SURFONIC N-95 | 18.000 |
| 10% calcium chloride dihydrate | 0.200 |
| LIPEX 100L | 1.670 |
| SAVINASE 16L | 1.670 |

Figure 10:
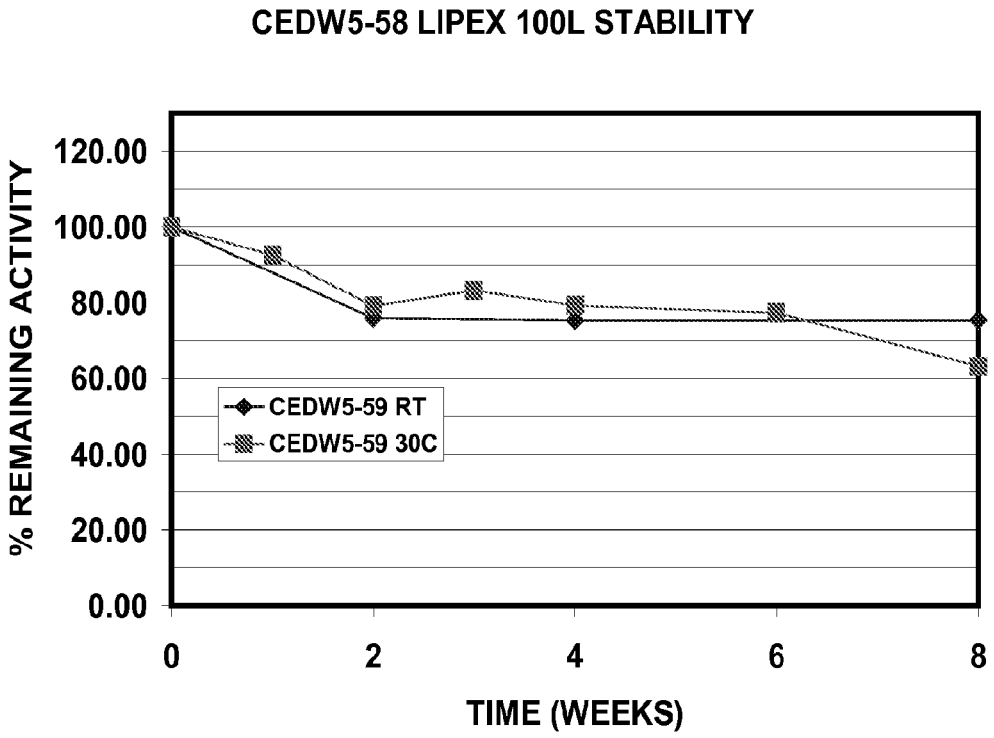
FIG. 10 shows the enzyme stability for a lipase in a detergent composition described in Example 5.
Figure 11:
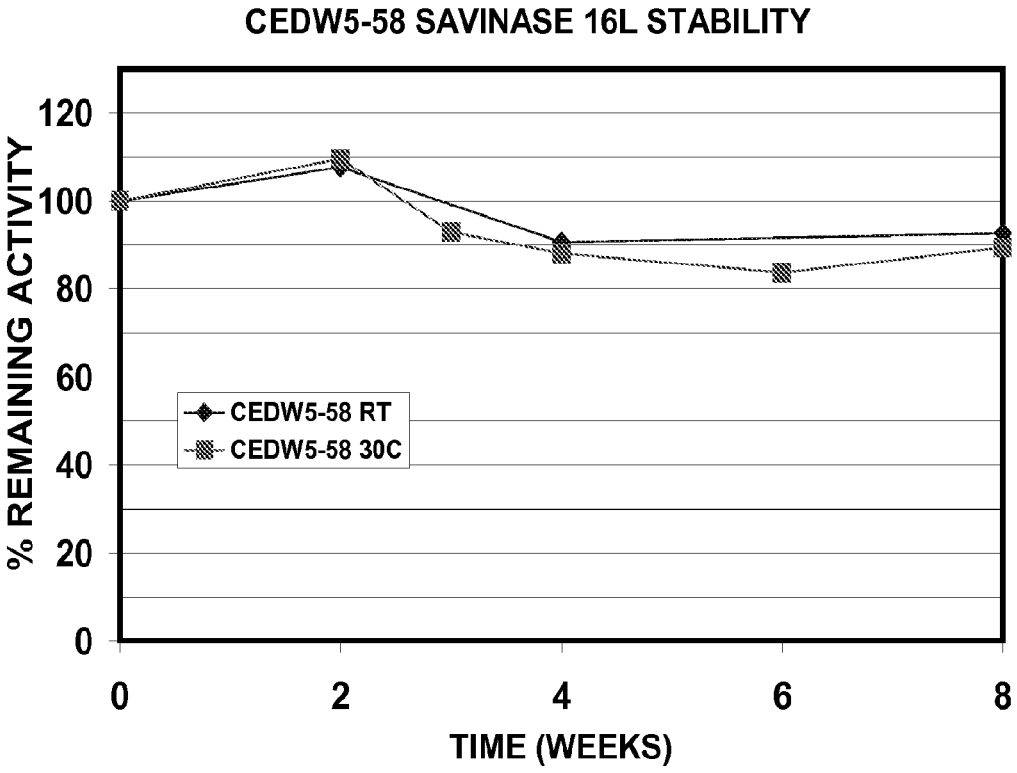
FIG. 11 shows the enzyme stability for an alkaline protease in a detergent composition described in Example 5.

The enzyme stability results for CEDW5-58 are given in FIG. 10 (Lipex 100L) and FIG. 11 (Savinase 16L). Both enzymes have good stability, and therefore CEDW5-58 is an acceptable liquid laundry detergent. The formulation is phase stable up to a temperature of at least 35° C.

Example 6

A formulation (CEDW5-75) containing only lipase was prepared. The pH was 4.91. The composition of this formulation is provided in Table 6:

TABLE 6

| | WT. % |
|---|---|
| DI water | 62.375 |
| Ethanol 95% | 6.000 |
| Sodium formate | 4.000 |
| BIO-SOFT S-101 | 2.604 |
| TEA | 0.651 |
| SURFONIC N-95 | 22.500 |
| 10% calcium chloride dihydrate | 0.200 |
| LIPEX 100L | 1.670 |

Figure 12:
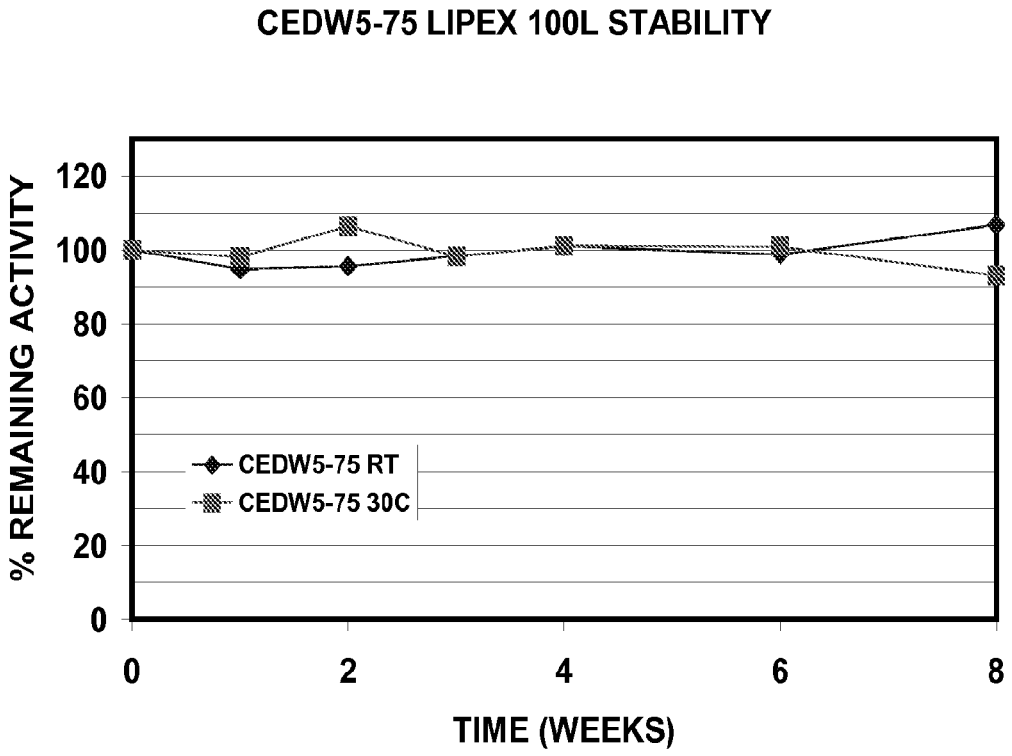
FIG. 12 shows the enzyme stability for a lipase in a detergent composition described in Example 6.

The enzyme stability results for Lipex 100 L are given in FIG. 12. The enzyme stability is good, and therefore CEDW5-75 is an acceptable liquid laundry detergent. The formulation is phase stable up to a temperature of at least 35° C.

Example 7

A formulation (CEDW5-77) containing only protease was prepared. The pH was 4.91. The composition of this formulation is provided in Table 7:

TABLE 7

| | WT. % |
|---|---|
| DI water | 62.375 |
| Ethanol 95% | 6.000 |
| Sodium formate | 4.000 |
| BIO-SOFT S-101 | 2.604 |
| TEA | 0.651 |
| SURFONIC N-95 | 22.500 |
| 10% calcium chloride dihydrate | 0.200 |
| SAVINASE 16L | 1.670 |

Figure 13:
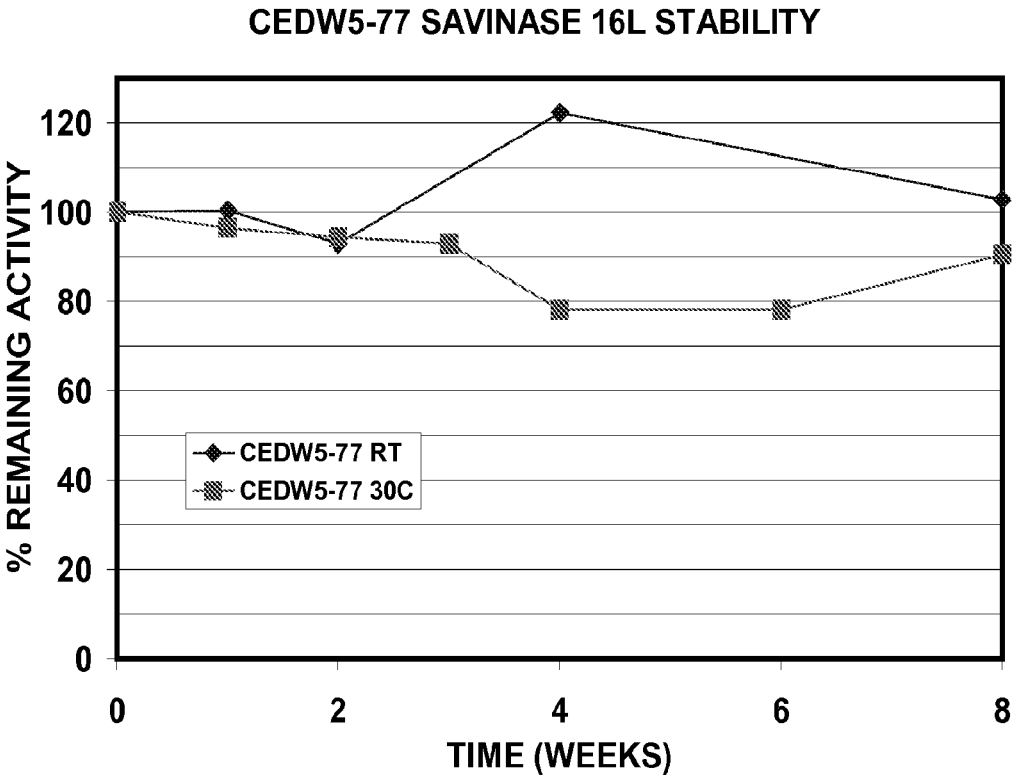
FIG. 13 shows the enzyme stability for an alkaline protease in a detergent composition described in Example 7.

The enzyme stability results for Savinase 16L are given in FIG. 13. The enzyme stability is good, and therefore CEDW5-77 is an acceptable liquid laundry detergent. The formulation is phase stable up to a temperature of at least 35° C.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention is further defined by the following paragraphs:

1. A detergent composition comprising (a) one or more alkaline proteases and/or one or more non-proteolytic enzymes, and (b) an enzyme stabilization system comprising a water-soluble calcium salt, a polyfunctional amino compound, and a low molecular weight carboxylic acid or a salt thereof, wherein the detergent composition has an acidic pH at which the alkaline protease(s) and/or non-proteolytic enzyme(s) are stable, but at which the alkaline protease(s) are virtually inactive.

2. The detergent composition of paragraph 1, which comprises one or more alkaline proteases and no non-proteolytic enzymes.
3. The detergent composition of paragraph 1, which comprises one or more alkaline proteases and one or more non-proteolytic enzymes.
4. The detergent composition of any of paragraphs 1-3, wherein the one or more alkaline proteases have a pH optimum of 8 to 12, e.g., 9 to 11

5. The detergent composition of any of paragraphs 1-4, wherein the one or more alkaline proteases are serine proteases, such as subtilisins, especially those derived from *Bacillus*, e.g., subtilisin Novo, subtilisin Carlsberg, subtilisin 309, subtilisin 147 and subtilisin 168.
6. The detergent composition of paragraph 1, which comprises one or more non-proteolytic enzymes and no alkaline proteases.
7. The detergent composition of any of paragraphs 1 and 3-6, wherein the one or more non-proteolytic enzymes are independently selected from the group consisting of amylase; arabinase; cutinase; carbohydrase; cellulase; galactanase; hemicellulase, e.g., mannanase; lipase; oxidase, e.g., laccase and/or peroxidise; pectate lyase; pectinase; xylanase; or xyloglucanase.
8. The detergent composition of composition of paragraph 7, wherein the one or more non-proteolytic enzymes comprising an amylase and/or a lipase.
9. The detergent composition of any of paragraphs 1-8, wherein the water-soluble calcium salt is calcium acetate, calcium chloride, calcium chloride dihydrate, calcium formate or calcium propionate, and preferably is present in an amount from about 0.1 to about 10 millimoles of calcium ion per liter, preferably from about 0.5 to about 5 millimoles of calcium ion per liter, and more preferably from about 0.5 to about 1.5 millimoles of calcium ion per liter.
10. The detergent composition of any of paragraphs 1-9, wherein the polyfunctional amino compound is an aliphatic organic compound comprising at least one amine grouping and at least two hydroxyl groups such as a polyalkanolamine, e.g., diethanolamine, triethanolamine, diisopropanolamine, tri-isopropanolamine, and tris(hydroxymethyl)aminomethane, in particular triethanolamine, and preferably is present in an amount of 0.1-5%, preferably from 0.1-1.5%, by weight of the detergent composition.
11. The detergent composition of any of paragraphs 1-10, wherein the low molecular weight carboxylic acid or salt thereof is acetic acid, formic acid, propionic acid, or a salt thereof, in particular formic acid or a salt thereof, e.g., sodium formate, and preferably is present in an amount from about 0.1% to about 6%, preferably from about 2% to about 4%, by weight of the detergent composition.
12. The detergent composition of any of paragraphs 1-11, which has a pH at which the alkaline protease(s) retain no more than 9% of their optimal activity, no more than 8%, no more than 7%, no more than 6%, no more than 5%, no more than 4%, no more than 3%, no more than 2%, no more than 1%, and preferably none of their activity.
13. The detergent composition of any of paragraphs 1-11, which has a pH of 4.5-5.5, such as about 4.7 to about 5.3, in particular about 4.8 to about 5.1.
14. The detergent composition of any of paragraphs 1-13, further comprising a surfactant system comprising one or more surfactants selected from nonionic and/or anionic and/or cationic and/or amphoteric and/or zwitterionic and/or semi-polar surfactants.
15. The detergent composition of paragraph 14, wherein the one or more surfactants are present at a level of from 0.1% to 60% by weight, such as 1% to about 40% by weight, e.g., about 3% to about 25% by weight.
16. The detergent composition of paragraph 14 or 15, wherein the surfactant system comprises one or more nonionic and/or anionic surfactants.
17. The detergent composition of any of paragraphs 14-16, wherein the surfactant system consists of dodecylbenzene sulfonic acid, e.g., a sodium salt or triethanolamine salt of dodecylbenzene sulfonate.
18. The detergent composition of any of paragraphs 14-16, wherein the surfactant system consists of dodecylbenzene sulfonic acid, e.g., a sodium salt or triethanolamine salt of dodecylbenzene sulfonate, and nonylphenol ethoxylate.
19. The detergent composition of any of paragraphs 14-16, wherein the surfactant system consists of dodecylbenzene sulfonic acid, e.g., a sodium salt or triethanolamine salt of dodecylbenzene sulfonate, and an alcohol ethoxylate.
20. The detergent composition of any of paragraphs 14-16, wherein the surfactant system consists of nonylphenol ethoxylate.
21. The detergent composition of any of paragraphs 14-16, wherein the surfactant system consists of an alcohol ethoxylate.
22. The detergent composition of any of paragraphs 14-16, wherein the surfactant system consists of nonylphenol ethoxylate and an alcohol ethoxylate.
23. The detergent composition of any of paragraphs 14-16, wherein the surfactant system consists of nonylphenol ethoxylate, alcohol ethoxylate, and dodecylbenzene sulfonic acid, e.g., a sodium salt or triethanolamine salt of dodecylbenzene sulfonate.
24. The detergent composition of any of paragraphs 14-16, wherein the surfactant system is free of alcohol ether sulfates and alkylpolyglycosides.
25. The detergent composition of any of paragraphs 1-24, further comprising suds suppressor.
26. The detergent composition of any of paragraphs 1-25, further comprising a softening agent.
27. The detergent composition of any of paragraphs 1-26, further comprising a dye-transfer inhibiting agent.
28. The detergent composition of any of paragraphs 1-27, further comprising one or more components selected from the group consisting of soil-releasing agents, abrasives, bactericides, tarnish inhibitors, fabric conditioners including clays, foam boosters, anti-corrosion agents, soil-suspending agents, anti-soil redeposition agents, dyes, bactericides, optical brighteners, hydrotropes, tarnish inhibitors, and perfumes.
29. A process for household or industrial laundering of a textile or garment, comprising washing the textile or garment in a wash bath with a detergent composition of any of paragraphs 1-28 at a pH of at least 7.
30. A process for laundering a fabric, comprising washing the fabric in a wash bath in a washing machine with a detergent composition of any of paragraphs 1-28 at a pH of at least 7.
31. A process for household or industrial dish or cutlery or other hard surface washing, comprising washing dishes, cutlery or another hard surface in a wash bath with a detergent composition of any of paragraphs 1-28 at a pH of at least 7.
32. The process of any of paragraphs 29-31, wherein the washing occurs for 5 to 60 minutes and at a temperature of 10-60° C., such as 20-40° C.
33. The process of any of paragraphs 29-32, wherein the washing occurs at a pH of 7-11.5.
34. The process of any of paragraphs 29-33, further comprising adding a bleaching agent to the wash bath.
35. The process of any of paragraphs 29-34, further comprising adding a builder system to the wash bath.

The invention claimed is:

1. A liquid detergent composition comprising (a) one or more alkaline proteases and one or more non-proteolytic enzymes, and (b) an enzyme stabilization system comprising a water-soluble calcium salt, a polyfunctional amino compound, and a low molecular weight carboxylic acid or a salt thereof, wherein the detergent composition has a pH from 4.5 to 5.5, and wherein the detergent composition has at least 60% residual activity when stored for eight weeks at 30° C., and wherein the alkaline protease(s) retain no more than 10% of their optimal activity.

2. The detergent composition of claim 1, wherein the one or more alkaline proteases have a pH optimum of 8 to 12.

3. The detergent composition of claim 1, wherein the one or more alkaline proteases have a pH optimum of 9 to 11.

4. The detergent composition of claim 1, wherein the one or more alkaline proteases is a serine protease.

5. The detergent composition of claim 1, wherein the one or more alkaline proteases is a subtilisin.

6. The detergent composition of claim 1, wherein the one or more alkaline proteases is derived from *Bacillus*.

7. The detergent composition of claim 1, wherein the one or more non-proteolytic enzymes are independently selected from the group consisting of amylase; arabinase; cutinase; carbohydrase; cellulase; galactanase; hemicellulase; lipase; oxidase; pectate lyase; pectinase; xylanase; or xyloglucanase.

8. The detergent composition of composition of claim 1, wherein the one or more non-proteolytic enzymes comprises an amylase and/or a lipase.

9. The detergent composition of claim 1, wherein the water-soluble calcium salt is calcium acetate, calcium chloride, calcium chloride dihydrate, calcium formate or calcium propionate.

10. The detergent composition of claim 1, wherein the water-soluble calcium salt is present in an amount from about 0.1 to about 10 millimoles of calcium ion per liter.

11. The detergent composition of claim 1, wherein the water-soluble calcium salt is present in an amount from about 0.5 to about 5 millimoles of calcium ion per liter.

12. The detergent composition of claim 1, wherein the water-soluble calcium salt is present in an amount from about 0.5 to about 1.5 millimoles of calcium ion per liter.

13. The detergent composition of claim 1, wherein the polyfunctional amino compound is an aliphatic organic compound comprising at least one amine grouping and at least two hydroxyl groups.

14. The detergent composition of claim 1, wherein the polyfunctional amino compound is a polyalkanolamine.

15. The detergent composition of claim 1, wherein the polyfunctional amino compound is diethanolamine, triethanolamine, di-isopropanolamine, tri-isopropanolamine, and/or tris(hydroxymethyl) aminomethane.

16. The detergent composition of claim 1, wherein the polyfunctional amino compound is present in an amount of 0.1-5% by weight of the detergent composition.

17. The detergent composition of claim 1, wherein the polyfunctional amino compound is present in an amount of 0.1-1.5% by weight of the detergent composition.

18. The detergent composition of claim 1, wherein the detergent composition has a pH from about 4.7 to about 5.3.

19. The detergent composition of claim 1, wherein the detergent composition has a pH from about 4.8 to about 5.1.

20. The detergent composition of claim 1, wherein the low molecular weight carboxylic acid is acetic acid, formic acid, propionic acid, or a salt thereof.

21. The detergent composition of composition of claim 1, wherein the one or more non-proteolytic enzymes comprises an amylase.

22. The detergent composition of composition of claim 1, wherein the one or more non-proteolytic enzymes comprises a lipase.

* * * * *